US007724132B1

(12) United States Patent
Daniel

(10) Patent No.: US 7,724,132 B1
(45) Date of Patent: May 25, 2010

(54) COVERT ALARM AND LOCATOR APPARATUS FOR MINERS

(76) Inventor: Sayo Isaac Daniel, 848 Brickell Key Dr., #3402, Miami, FL (US) 33131

( * ) Notice: Subject to any disclaimer, the term of this patent is extended or adjusted under 35 U.S.C. 154(b) by 331 days.

(21) Appl. No.: 11/849,886

(22) Filed: Sep. 4, 2007

Related U.S. Application Data

(63) Continuation-in-part of application No. 10/979,894, filed on Nov. 1, 2004, now Pat. No. 7,265,666, and a continuation-in-part of application No. 11/560,762, filed on Nov. 16, 2006, now abandoned, and a continuation-in-part of application No. 11/619,189, filed on Jan. 2, 2007, and a continuation-in-part of application No. 11/626,356, filed on Jan. 23, 2007.

(51) Int. Cl.
*G08B 1/08* (2006.01)

(52) U.S. Cl. ..... 340/539.13; 340/539.11; 340/539.22

(58) Field of Classification Search ..... 340/539.1, 340/539.11, 539.13, 539.2, 539.22, 539.24, 340/539.21
See application file for complete search history.

(56) References Cited

U.S. PATENT DOCUMENTS

| | | | | |
|---|---|---|---|---|
| 3,750,023 | A * | 7/1973 | Weissenborn et al. | 455/100 |
| 4,491,971 | A * | 1/1985 | Webb et al. | 455/100 |
| 4,495,495 | A * | 1/1985 | Ormanns et al. | 340/7.61 |
| 4,495,496 | A * | 1/1985 | Miller, III | 340/10.2 |
| 4,747,120 | A * | 5/1988 | Foley | 379/38 |
| 5,438,321 | A * | 8/1995 | Bernard et al. | 340/573.4 |
| 5,635,907 | A * | 6/1997 | Bernard et al. | 340/573.4 |
| 5,995,017 | A * | 11/1999 | Marsh et al. | 340/10.2 |
| 6,339,709 | B1 * | 1/2002 | Gladwin et al. | 455/115.1 |
| 6,788,200 | B1 * | 9/2004 | Jamel et al. | 340/539.13 |
| 7,005,980 | B1 * | 2/2006 | Schmidt et al. | 340/539.13 |
| 7,265,666 | B2 * | 9/2007 | Daniel | 340/539.11 |
| 7,511,625 | B2 * | 3/2009 | Mardirossian | 340/573.1 |
| 2004/0021569 | A1 * | 2/2004 | Lepkofker et al. | 340/568.1 |
| 2008/0137589 | A1 * | 6/2008 | Barrett | 370/327 |
| 2009/0140852 | A1 * | 6/2009 | Stolarczyk et al. | 340/539.13 |

* cited by examiner

*Primary Examiner*—Travis R Hunnings
(74) *Attorney, Agent, or Firm*—Sanford J. Asman

(57) ABSTRACT

An article of footwear, such as a work shoe, is worn by miners. The footwear includes a location determining module which is able to locate its position by means of the timing and data contained in signals sent by it to locator devices which are placed at known locations throughout the mine, and which respond to transmissions made by the locator module. The footwear also contains a low frequency RF module which enables it to selectively transmit an alarm signal encoded with its location upon the selective activation by the wearer. In various embodiments, the invention can include sensors which are able to monitor physiological data of the wearer or the survivability of the ambient conditions where the footwear is located. Embodiments of the invention also provide the wearer with two-way communications capability. The various electronic components of the invention, can be formed in as a flexible modular unit which can be attached to existing footwear, or formed to new footwear during the manufacturing process, or thereafter.

12 Claims, 3 Drawing Sheets

COVERT ALARM AND LOCATOR APPARATUS FOR MINERS

CROSS-REFERENCE TO RELATED APPLICATIONS

The present application is a continuation-in-part of U.S. patent application Ser. No. 10/979,894 entitled FOOTWEAR COVERT ALARM AND LOCATOR APPARATUS filed by Sayo Isaac Daniel on Nov. 1, 2004, to be issued as U.S. Pat. No. 7,265,666 on Sep. 4, 2007; Ser. No. 11/560,762, entitled HAND WORN ATTIRE WITH BUILT-IN GPS RECEIVER, filed Nov. 16, 2006; Ser. No. 11/619,189 entitled FOOTWEAR WITH INTEGRATED VIDEO GAMING APPARATUS, filed Jan. 2, 2007; and Ser. No. 11/626,356 entitled BACKPACK HAVING A COVERT ALARM AND LOCATOR APPARATUS, filed Jan. 23, 2007, all by the present inventor, the priority of all of which are claimed, and the contents of all of which are hereby incorporated by reference.

BACKGROUND OF THE INVENTION

The present invention relates to an article of footwear, such as a work shoe. In particular, the present invention relates to a piece of footwear which includes a location determining and identifying means, such as a module which interacts with portable, or hardwired, locators which are placed in known locations throughout the mine and which are used to periodically update the location of the footwear, together with means for selectively activating an alarm signal encoded with location and identification data, whereby the wearer of such footwear can selectively send out a distress, or "find me" signal to monitoring personnel.

Underground mines, which are characterized by their tough working conditions and hazardous environments, require a fool-proof mine-wide communication system to provide for the smooth functioning of mine operations and to provide communications means to be employed between miners underground and personnel on the surface in order to provide for the safety of the underground miners. Existing systems based on hard-wired communication systems are unable to withstand the very disaster conditions which endanger miners who may be trapped due to a cave-in or other action which traps miners and simultaneously cuts any wired lines. Mine topology and the complexity of mine tunnels and structures further hinds the survivability of hard-wired line communications systems.

While numerous disasters, wherein miners have been trapped underground, often with tragic consequences, have been reported, no known means for locating miners trapped underground, other than the boring of holes, often without positive results, is generally utilized.

In part, the failure to provide a means for locating miners trapped underground has been a problem with finding a technology which can work in the hostile underground environment of mines in which radio signals do not, generally, propagate well. Yet another problem which exists, but which is often unmentioned, in providing apparatus able to locate miners has been the reluctance on the part of miners, themselves, to use a system which permits their every move to be tracked and followed, and which thereby instills in them a feeling that they are under constant watch, even when carrying out their normal work duties.

Thus, while the West Virginia legislature unanimously passed legislation in January 2006 requiring miners to wear tracking devices and to carry wireless emergency communications equipment when working underground, as a legislative response to the deaths of fourteen miners in two separate incidents in the first three weeks of that year, the legislation included a provision to protect miners' privacy while they are wearing wireless tracking devices, by prohibiting the firing of or discrimination against any miner whose location is being tracked during non-emergency monitoring.

Similarly, there have been attempts at federal legislation to improve miners' safety by providing means for tracking the location of underground miners, so that swift emergency response can be provided in the event of a mining disaster.

As noted, there are two primary problems in providing devices which can enable the location of miners trapped underground. The first is one of technology, while the second is one involving the reluctance of miners to be tracked, unless they are actually in danger.

SUMMARY OF THE INVENTION

In accordance with the present invention, an article of footwear is provided with means for determining its location, together with means permitting the wearer of the footwear to selectively activate an alarm signal which is encoded with the location information of the wearer. By limiting the transmission of location information of the wearer to only those times when the wearer affirmatively chooses to actively initiate the alarm signal, numerous benefits over the heretofore known devices and proposed devices are provided. First, the privacy of the individual miners is preserved, as no signals are transmitted unless and until they choose to transmit them. This, alone, provides the miners with an incentive to wear the footwear at all times, as they were otherwise inhibited from doing. Since they will not regard the covert alarm locator apparatus of the present invention as being a tool intended to be used to watch and monitor their every move, they will have no reason to disable it or to decline to wear it. Further, by limiting the transmission of signals to only those miners and at only those times when a miner selectively chooses to send an alarm signal, the present invention will be significantly easier to monitor, as the only signals transmitted will be those activated by miners in distress without additional spurious signals and "noise" from units worn by miners who are not in any distress.

Yet another benefit of the present invention is that by limiting its transmissions to only those times when a miner in distress actually initiates the alarm signal, the battery life of the apparatus is preserved allowing the units to be worn for far longer periods without need for recharging.

DETAILED DESCRIPTION OF THE PREFERRED EMBODIMENTS

Figure 1:
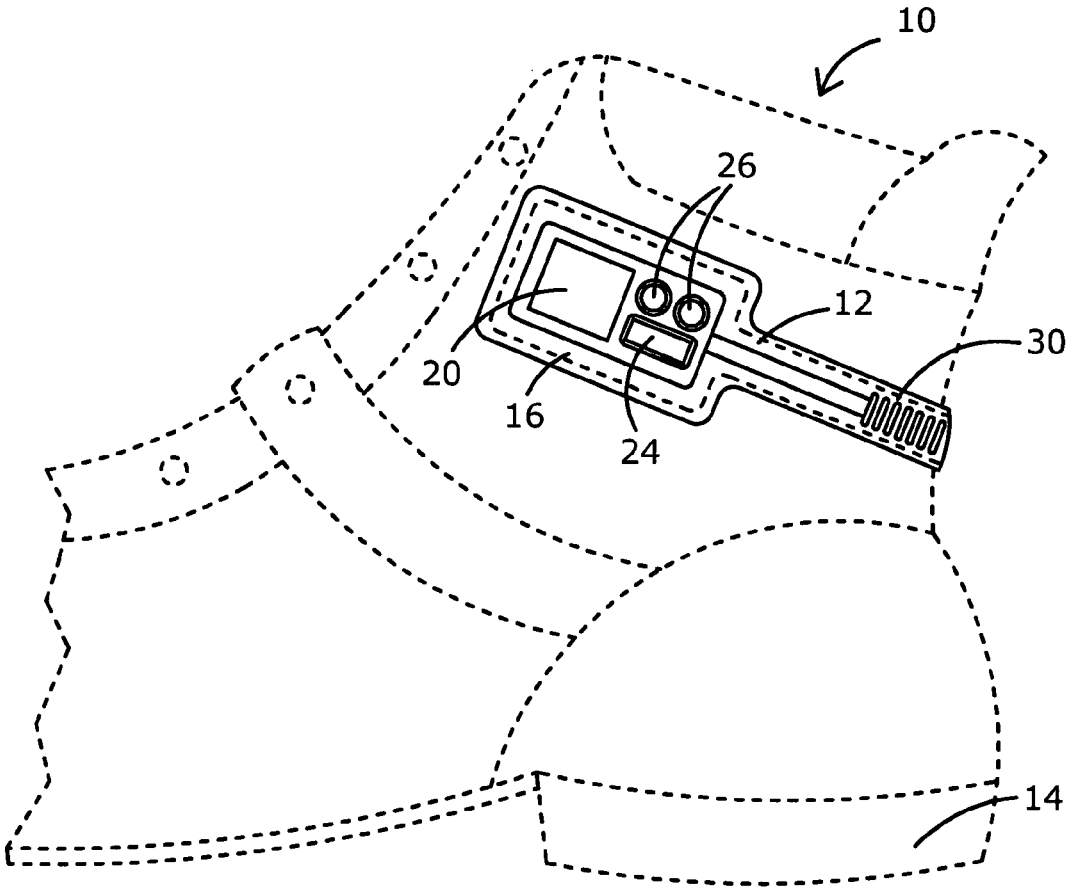
FIG. 1 is a perspective view of a work shoe including the present invention.

With reference to FIG. 1, in accordance with the present invention a work shoe 10 (shown in shadow) employs a module 12 including the invention, which could, alternatively, be mounted within the sole 14 of the work shoe 10. The module 12 can be formed as a complete unit adapted to be fitted onto a standard work shoe at the time that it is manufactured, or bonded thereto, at a later time.

Figure 2:
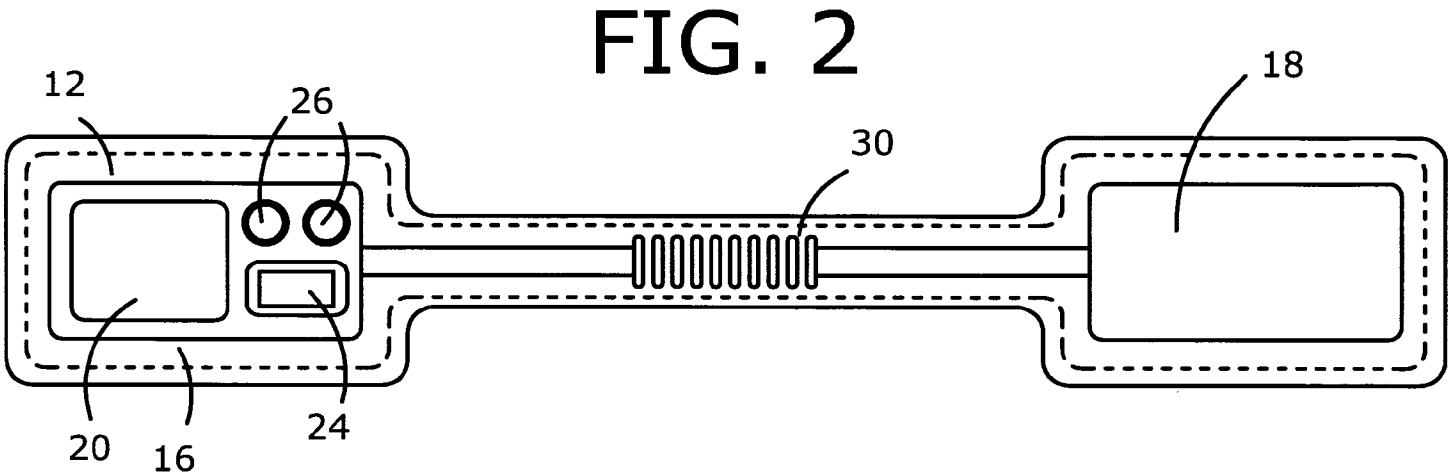
FIG. 2 is a top view of the module shown attached to the work shoe of FIG. 1.
Figure 3:
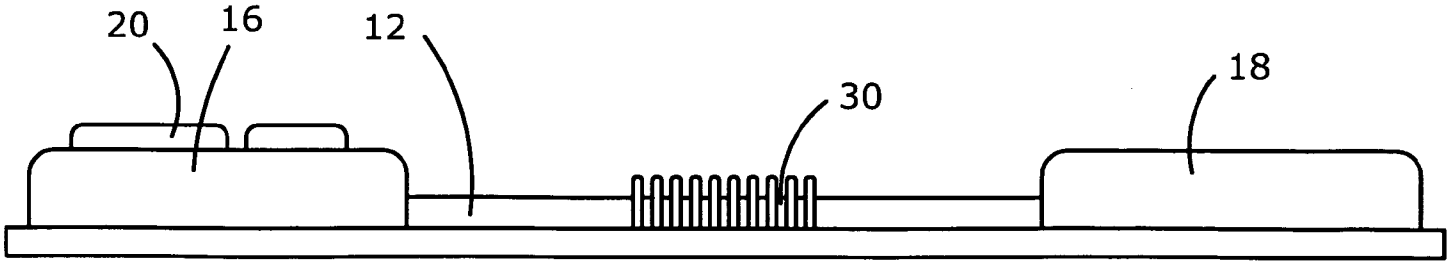
FIG. 3 is a side view of the module shown attached to the work shoe of FIG. 1.
Figure 4:
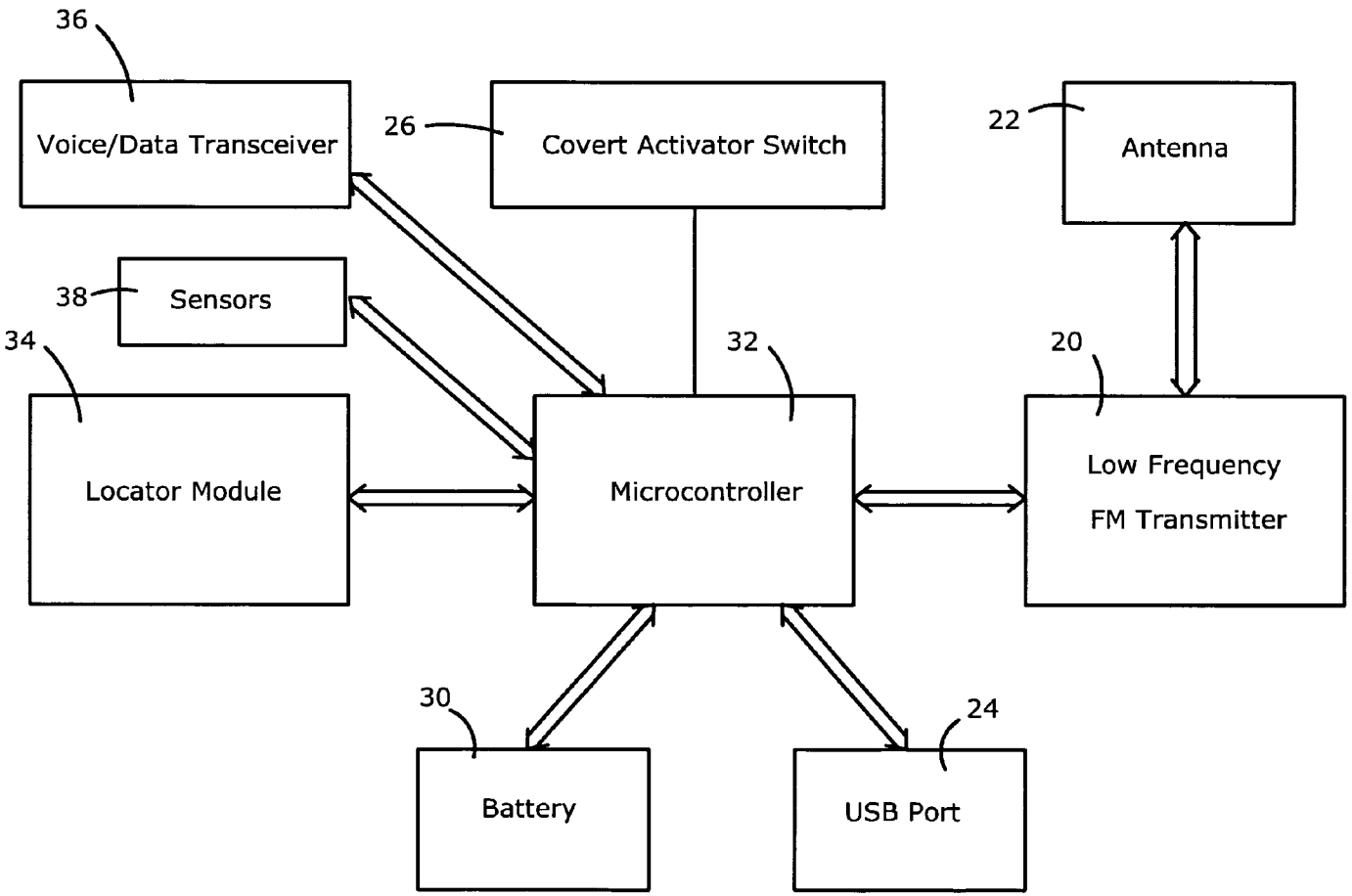
FIG. 4 is block diagram of the present invention, along with a number of optional modules used in different embodiments.

As shown more clearly in FIGS. 2-4, the module 12 has two sections 16, 18 which include the components making up the covert alarm locator apparatus of the present invention. In particular, the first section 16 of the module 12 includes a radio transmitter 20, along with an associated antenna 22. It also includes a port, such as mini-USB port 24, as well as a covert alarm activator switch, which is comprised of a pair of buttons 26 which are wired in series, so that both buttons 26 must be pressed simultaneously to send an alarm signal, thereby minimizing the likelihood of false alarms.

The other section 18 of the module 12 houses the battery 28 which is used to power the system, with the sections 16, 18 being connected by means of a flexible center section 30 in which flexible conductors (not shown) are housed. With particular reference to FIG. 4, the section 16 holds the electronic circuitry which operates the unit 12. In particular, the circuitry includes a microcontroller 32, which is connected to the covert activator switch (comprised of buttons 26). The microcontroller is also connected to the transmitter 20 (which is, of course, connected to the antenna 22), the battery 30 and the mini-USB port 24. In the preferred embodiment of the invention, the microcontroller 32 is also attached to a location determining module 34, and the microcontroller 32 includes a non-volatile memory portion which holds its program and which includes an electronic identification number which is uniquely associated with the wearer of the shoe 10.

The location determining module 34 used in the present invention includes a relatively short range receiver which receives signals from a series of radio locator transmitter beacons which are placed in known locations throughout the mine, and which may be either portable or hardwired for power and operation. The purpose of the location determining module is to enable the footwear to update its position based on its proximity to the transmitter beacons, each of which has a unique identification which is read by and stored in the location determining module 34. Alternatively, the location determining module 34 can be comprised of a transponder which transmits signals which are received by the nearest locator beacons (which would then be in the form of transceivers). Upon receipt of a signal from a shoe module the locator beacons would reply with a transmission encoded with their identification. Based on the identification of the locator beacon, relative to the location determining module 34, and the time between the transmission by the module 34 and the reception of the return signal from the locator beacon, the location determining module can determine its distance from the nearest locator beacon, or beacons, whereby its own location can be determined, either directly (based on the fact that it operates while within a mine tunnel, and there can only be some finite number of locations within the tunnels which are also a given distance from a locator beacon), or, alternatively, by storing the last several returns (with both distance and locator beacon data) whereby the location of the module 34 can be determined by triangulation from the known locator beacon positions.

The system of the using frequency modulated (FM) transceivers with directional or active antenna linked with leaky feeder cables or wire and repeater amplifiers at regular intervals provide for reliable and appropriate mine-wide communication systems for underground mines. FM transceivers inside either the sole 14 of the footwear 10, or in modules 12 attached to the footwear 10 provide a means for carrying the locator modules 34 wherever the miners are working or may become trapped, including places which become inaccessible as a result of a mining disaster. RF modules capable of reliably communicating the location of trapped miners will provide the miners with the ability to selectively send their location to monitoring stations, thereby increasing their safety by reducing the time that it would take for emergency personnel to pinpoint their locations, while at the same time preserving their privacy and the battery life of the units when they are not in danger.

Another benefit of the present invention is that it is able to put a vital piece of safety equipment on a miner without having to add to the equipment which a miner would has to carry, as all mine workers wear footwear, and their footwear will not be separated from them should there be a disaster. Thus, by providing a communications link in the form of a low frequency RF signal, which is better able to propagate through coal or other material with minimal attenuation than high frequency RF signals, together with an alarm signal which is encoded with the location of the wearer, and which is selectively activated on demand of the wearer of the footwear stands the best chance of providing an acceptable, viable means for quickly locating miners trapped underground.

As described above, the present invention provides a trapped or endangered miner with a piece of safety equipment, and it provides the mine operators with a means for locating the trapped miners. With the actual locations of the miners being transmitted, rescue teams will receive needed guidance to create efficient rescue plans. In a first alternative embodiment, the invention can be equipped with two-way communications capability, through the use of a low frequency FM transceiver module 36 whereby the miners can communicate with the rescue personnel, and in another alternative embodiment of the invention, the footwear 10 can be equipped with sensors 38, which can sense physiological factors, such as blood oxygen levels, or ambient factors, such as oxygen levels, and which data can be transmitted to the rescue personnel.

As will be understood by those skilled in the art, by limiting the activation of the invention to only those times when the wearer wishes to send an emergency signal, battery life is preserved and used only in such emergencies, thereby allowing rescue teams to monitor the location and condition of miners throughout the rescue process, and to adjust their plans accordingly.

While the invention has been described in connection with specific embodiments and applications, the inventor does not intend to restrict the description to the examples shown. Persons skilled in the art will recognize that the above apparatus and methods may be modified or changed without departing from the general scope of the present description, the intention of the inventor being to include all such modifications and alterations in so far as they come within the scope of the appended claims or the equivalents thereof.

I claim:

1. An article of footwear comprising:

(a) means for periodically determining location data of said article of footwear based on the location of fixed locator devices having known positions comprising a transponder which derives its position by transmitting a signal to a locator device, which locator device sends a return encoded with an identification for said locator device, whereby said means for periodically determining the location of said article of footwear is able to derive its location, as a known distance from said locator device; and (b) means for the selective transmission of an alarm signal encoded with said location data, said transmitted signal having a frequency and modulation selected to minimize the attenuation thereof through underground materials, and said alarm signal only being transmitted upon the selective activation by the wearer of said footwear.

2. The article of footwear of claim 1, wherein said means for periodically determining the location of said article of footwear is derives its position by receiving and storing returns from multiple locator devices.

3. The article of footwear of claim 2 wherein said means for selectively transmitting a signal encoded with said location data transmits a frequency modulated (FM) signal.

4. The article of footwear of claim 2 wherein said means for selectively transmitting a signal encoded with said location data transmits a low frequency RF signal.

5. The article of footwear of claim 1 wherein said electronics are housed in a module bonded to a standard work shoe.

6. The article of footwear of claim 5 which has been adapted for use by miners.

7. The article of footwear of claim 6 further comprising an electronic identification number which is uniquely associated with a specific wearer.

8. The article of footwear of claim 7 further comprising at least one sensor which monitors a physiological parameter of the wearer.

9. The article of footwear of claim 8 wherein said at least one sensor monitors the blood-oxygen level of the wearer.

10. The article of footwear of claim 7 further comprising at least one sensor which monitors the ambient conditions where the footwear is located.

11. The article of footwear of claim 10 wherein said at least one sensor monitors the oxygen level of the ambient atmosphere adjacent the footwear.

12. The article of footwear of claim 7 further comprising two-way voice communications capability.

* * * * *